US010111521B2

(12) United States Patent
Chen et al.

(10) Patent No.: US 10,111,521 B2
(45) Date of Patent: Oct. 30, 2018

(54) ADJUSTABLE ROTARY SHELF ASSEMBLY AND METHOD OF USE

(71) Applicant: Hardware Resources, Inc., Bossier City, LA (US)

(72) Inventors: Alan Chen, Lewisville, TX (US); Dennis McGregor, Dallas, TX (US); Jay Pannebaker, Shreveport, LA (US); Dan Wagner, Shreveport, LA (US); Marisa Sanchez, Bossier City, LA (US)

(73) Assignee: Hardware Resources, Inc., Bossier City, LA (US)

( * ) Notice: Subject to any disclaimer, the term of this patent is extended or adjusted under 35 U.S.C. 154(b) by 0 days.

(21) Appl. No.: 15/409,179

(22) Filed: Jan. 18, 2017

(65) Prior Publication Data

US 2018/0199709 A1 Jul. 19, 2018

(51) Int. Cl.
*A47B 49/00* (2006.01)
*A47B 57/58* (2006.01)

(52) U.S. Cl.
CPC ..... *A47B 49/006* (2013.01); *A47B 57/583* (2013.01)

(58) Field of Classification Search
CPC ... A47B 81/002; A47B 49/006; A47B 49/004; A47B 2063/005; A47B 57/583
USPC ..... 312/322, 223, 350, 282, 323; 108/42
See application file for complete search history.

(56) References Cited

U.S. PATENT DOCUMENTS 2,580,032 A * 12/1951 Lindelof ..... A47B 63/04 108/140
3,550,982 A * 12/1970 Zaidan ..... F25D 25/027 312/298
4,124,262 A * 11/1978 Schill ..... A47B 49/004 16/378
4,582,372 A * 4/1986 Cooper ..... A47B 46/00 108/140
4,639,051 A * 1/1987 DeBruyn ..... A47B 96/16 312/275
4,738,495 A 4/1988 Mitts
4,959,582 A * 9/1990 Meyer ..... E05D 15/36 16/358
8,020,951 B2 * 9/2011 Twellmann ..... A47B 81/002 312/238
9,119,470 B2 * 9/2015 Kreyenkamp ..... A47B 81/002
(Continued)

*Primary Examiner* — Jose V Chen
(74) *Attorney, Agent, or Firm* — Schultz & Associates, P.C.

(57) ABSTRACT

A rotary shelf assembly for a blind corner cabinet is provided. The apparatus is easily reconfigured to accommodate left and right-hand configurations and does not contact the partitions of the cabinet during stowage or deployment. The apparatus is comprised of a center pole secured to a cabinet frame with a universal frame bracket. The frame bracket has a set of opposing flanges attached to a base through which the center pole extends. A rotary coupling is secured to the base of the frame bracket. A rotary support engages the rotary coupling and rotates about the center pole. A shelf is adjustably and slidably attached to the rotary support by a set of slide assemblies. More than one shelf can be independently rotated about the center pole from a stowed position to a rotated position. Each shelf can also slide linearly along the set of slide assemblies to a deployed position.

21 Claims, 15 Drawing Sheets

(56) References Cited

U.S. PATENT DOCUMENTS

| | | | | |
|---|---|---|---|---|
| 2010/0084952 | A1* | 4/2010 | Sagel | A47B 46/00 312/238 |
| 2011/0193455 | A1* | 8/2011 | Kreyenkamp | A47B 81/002 312/238 |
| 2016/0045039 | A1* | 2/2016 | McGregor | A47B 49/006 211/144 |

* cited by examiner

ADJUSTABLE ROTARY SHELF ASSEMBLY AND METHOD OF USE

FIELD OF THE DISCLOSURE

This disclosure relates to cabinet shelving assemblies. In particular, the disclosure relates to a rotary shelf assembly designed to fit within a blind corner cabinet.

BACKGROUND OF THE DISCLOSURE

Blind corner cabinets present a problem of an inaccessible space. A blind corner cabinet occurs at a set of intersecting walls. At the intersection, a space is created that cannot be easily accessed by a front cabinet door.

A rotary shelf assembly offers one way to access the dead space. Rotary shelf assemblies typically provide semi-circular shelves rotatably attached to a centrally positioned pole. The shelves rotate about the pole from a stored position within the dead space and extend to a deployed position outside the cabinet.

Prior art rotary shelf assemblies are not completely satisfactory. Providing rotating shelves that can accommodate the dead space without impacting interior cabinet panels during deployment and stowing is a problem. Furthermore, there is no satisfactory way to adjust the height of the shelves during or after installation.

U.S. Pat. No. 4,738,495 to Mitts discloses a rotary shelf storage assembly for a blind corner base cabinet. The device comprises a lower shelf and an upper shelf rotatably supported on a vertical post. The vertical post is secured to the cabinet carcass by a lower mounting bracket attached to the cabinet and an upper mounting bracket also attached to the cabinet. The lower mounting bracket is rotatably engaged with a lower mounting base and the upper mounting bracket is rotatably engaged with an upper mounting base. Each mounting base is connected to a set of slide assemblies which are further connected to the lower and upper shelves, respectively. In order to adjust the height of the upper shelf, the vertical post must be removed from both mounting brackets in order to access the mounting hardware used to mount the mounting brackets to the cabinet. In order to switch between right-hand and left-hand orientations of corner cabinets, the shelves must be completely removed from engagement with the slide assemblies and the slide assemblies repositioned on the mounting bases.

Therefore there is a need for a rotary shelf assembly for a blind corner that is simple to install, is easily adjusted without disassembly, does not impact interior cabinet panels during use, and can easily accommodate left and right-hand oriented cabinet arrangements.

SUMMARY

The apparatus disclosed is a semi-circular rotary shelf assembly for utilizing the dead space of a blind corner cabinet. The apparatus is easily reconfigured to accommodate left and right-hand configurations and does not contact the partitions of the cabinet during stowage or deployment. Height adjustment is accomplished without disassembly.

The apparatus is comprised of a center pole secured to a cabinet frame with a universal frame bracket. The frame bracket has a set of opposing flanges attached to a base through which the center pole extends. A rotary coupling is secured to the base of the frame bracket. A rotary support engages the rotary coupling and rotates about the center pole. A shelf is adjustably and slidably attached to the rotary support by a set of slide assemblies. While one shelf is possible, in a preferred embodiment, more than one shelf is rotatably secured to the central pole with additional frame brackets.

In use, each shelf can be independently rotated about the center pole from a stowed position within the dead space of a corner cabinet through a rotated position through a door opening, to a deployed position outside the opening. In the course of deployment, each shelf slides linearly along the set of slide assemblies.

A height adjustment of a shelf is accomplished by altering the vertical position of the frame bracket with respect to the cabinet frame. In order to accomplish the height adjustment, it is unnecessary to remove the center pole or the rotary support. The frame bracket can be repositioned with respect to the cabinet frame without detaching the rotary support from engagement with the rotary coupling.

BRIEF DESCRIPTION OF THE DRAWINGS

Reference will now be made to the drawings, wherein like parts are designated by like numerals, and wherein.

DETAILED DESCRIPTION

Figure 1:
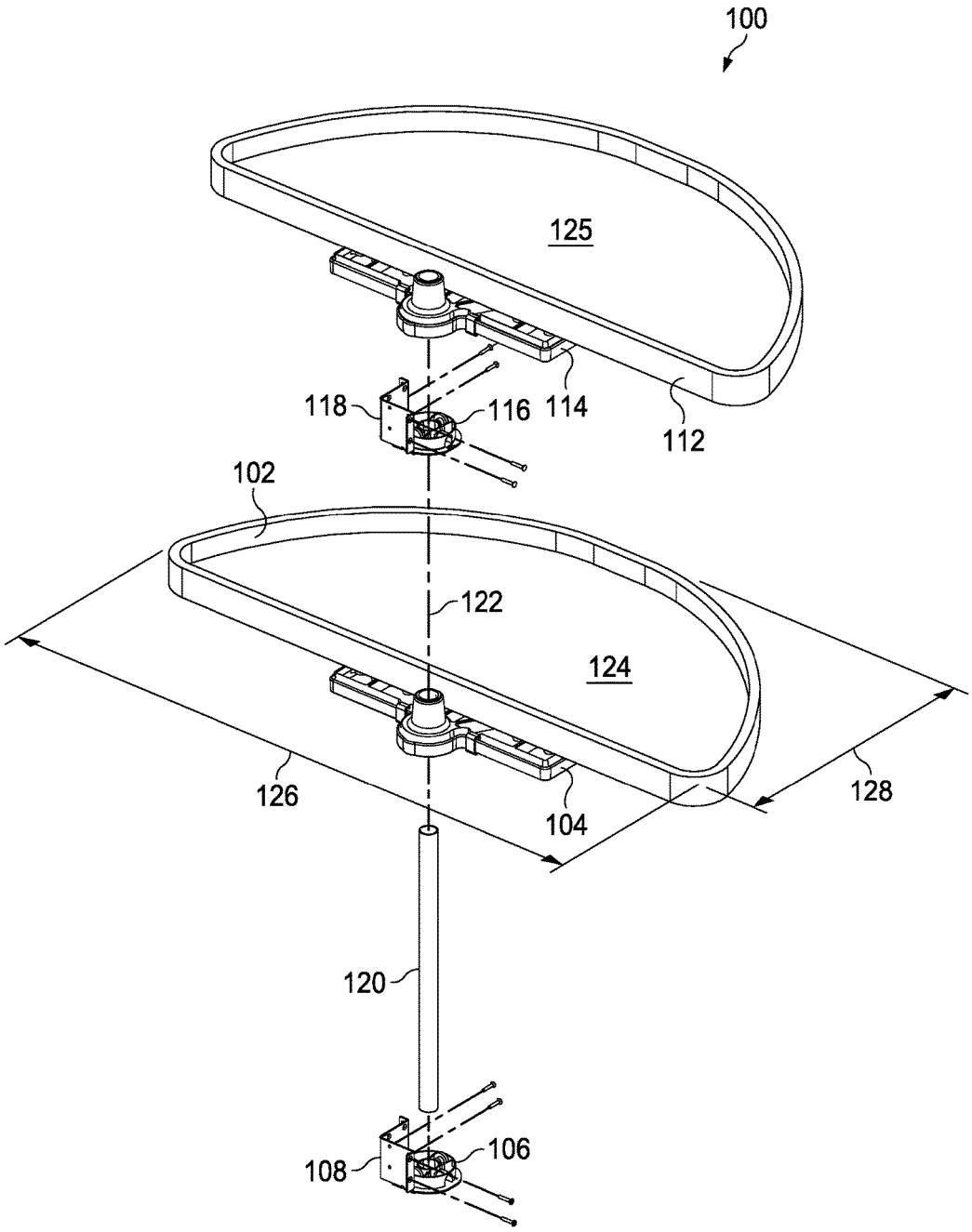
FIG. 1 is an exploded isometric view of a rotary shelf assembly of a preferred embodiment.

In the descriptions that follow, like parts are marked throughout the specification and drawings with the same numerals, respectively. The drawing figures are not necessarily drawn to scale and certain figures may be shown in exaggerated or generalized form in the interest of clarity and conciseness.

Referring to FIG. 1, rotary shelf assembly 100 is comprised of one or more shelves rotatable about a center rod and each linearly slidable along a rotary support in order to provide storage access to the dead space behind a blind corner cabinet. In a preferred embodiment, the shelves are manufactured of a lightweight plywood or other material such as injection molded plastic or polyvinyl chloride (PVC). In a preferred embodiment, the rotary support is manufactured of injection molded plastic or a light metal alloy such as brass, magnesium, or aluminum.

Shelf 102 is generally semi-circular and is supported by and slidably attached to rotary support 104. Rotary support 104 is supported by and rotatably engaged with rotary coupling 106. Rotary coupling 106 is mounted to universal frame bracket 108. Shelf 112 is generally semi-circular and is slidably attached to rotary support 114. Rotary support 114 is rotatably engaged with rotary coupling 116 which is mounted universal frame bracket 118. Rod 120 is vertically oriented and passes through the universal frame brackets, the rotary couplings, and the rotary supports. Set screws removably secure the rotary couplings to rod 120.

Rotary supports 104 and 114 and their attached shelves 102 and 112 rotate about longitudinal axis 122 of rod 120. Shelves 102 and 112 have smooth, uninterrupted top surfaces 124 and 125, respectively. Top surfaces 124 and 125 are free from any mounting structure. In one embodiment, shelves 102 and 112 are identically shaped having width 126 and depth 128. In a preferred embodiment, width 126 is 32 inches, 35 inches, or 38 inches for fitment within available common industry sizes of blind corner cabinets. Other widths ranging from 24 to 48 inches are envisioned. In order to maximize shelf space, larger shelves are used in larger cabinets. In a preferred embodiment, depth 128 ranges from 10 to 18 inches. The universal bracket, the rotary coupling, and the rotary support can accommodate the entire range of shelf sizes.

Figure 2:
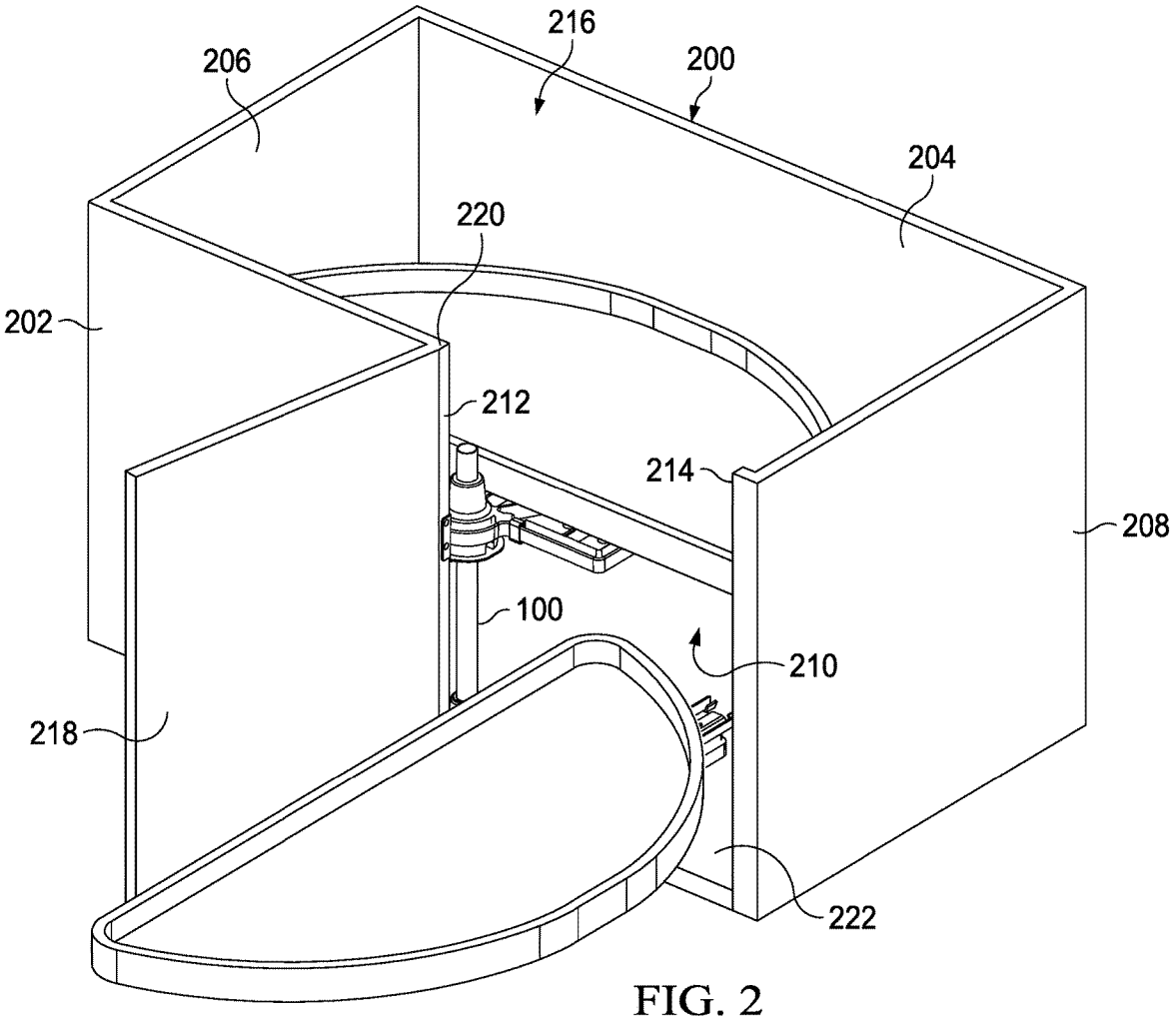
FIG. 2 is an isometric view of a rotary shelf assembly of a preferred embodiment mounted to a blind corner cabinet.
Figure 3A:
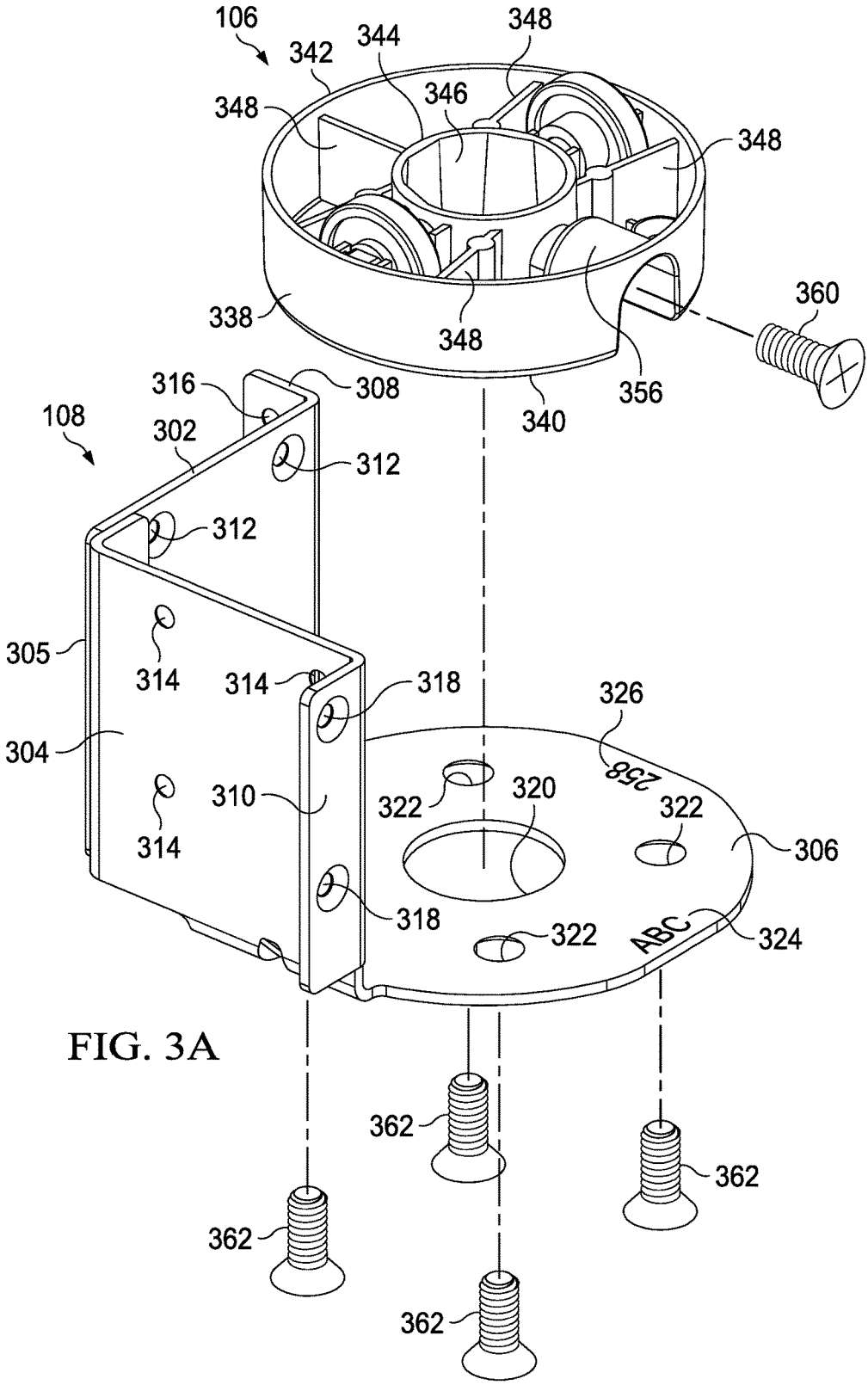
FIG. 3A is an exploded partial isometric view of a universal frame bracket and rotary coupling of a preferred embodiment.
Figure 3B:
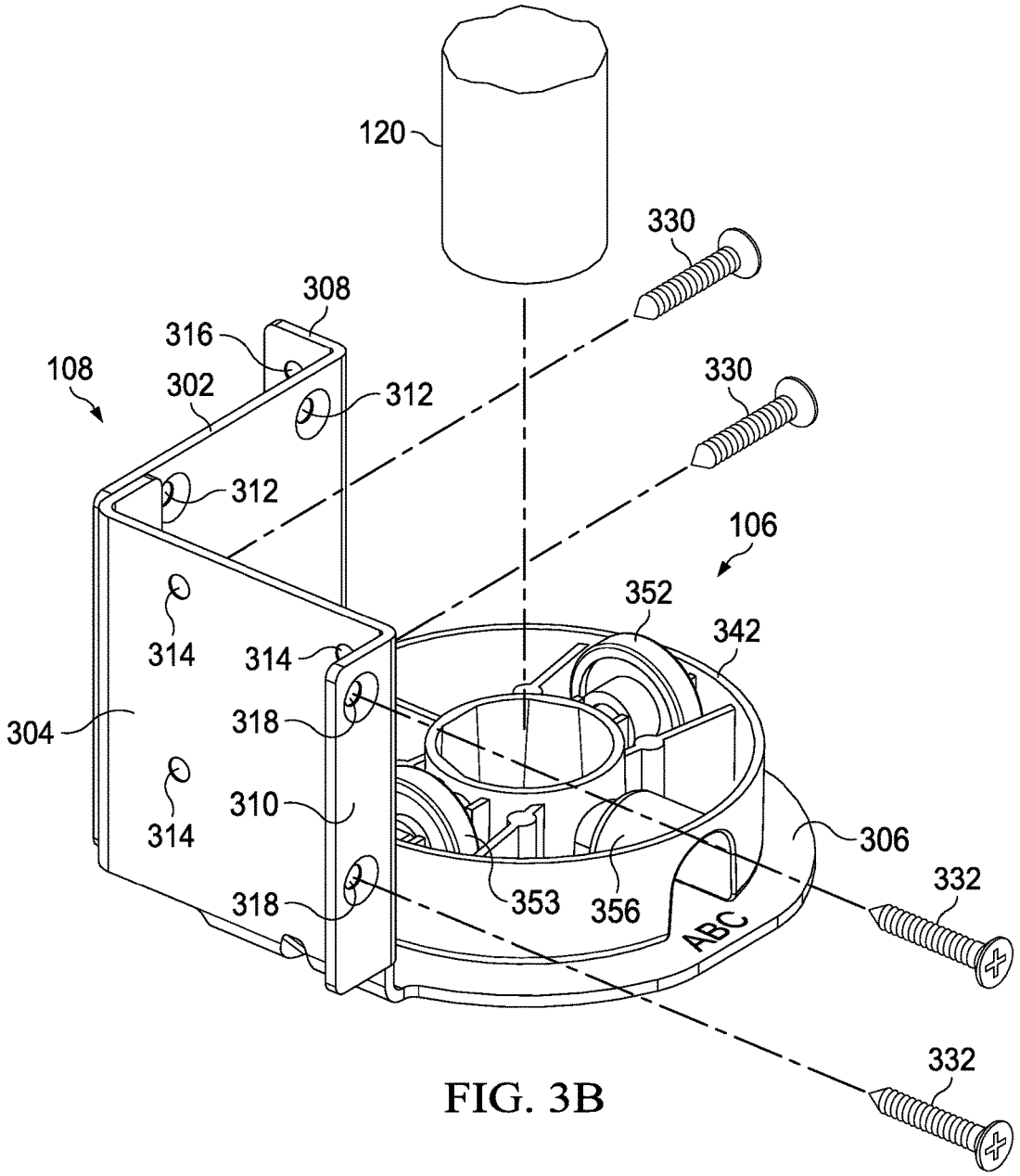
FIG. 3B is an exploded partial isometric view of a universal frame bracket and rotary coupling of a preferred embodiment.
Figure 3C:
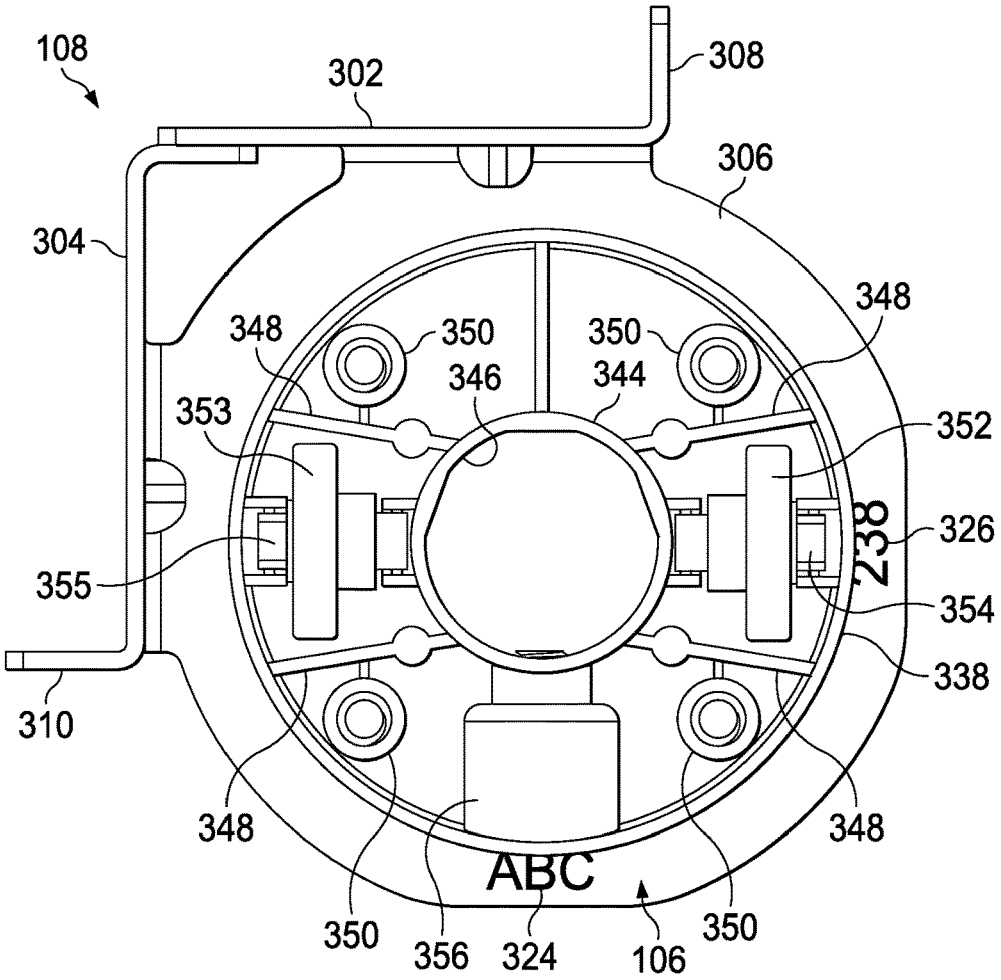
FIG. 3C is a plan view of a universal frame bracket and rotary coupling of a preferred embodiment.
Figure 3D:
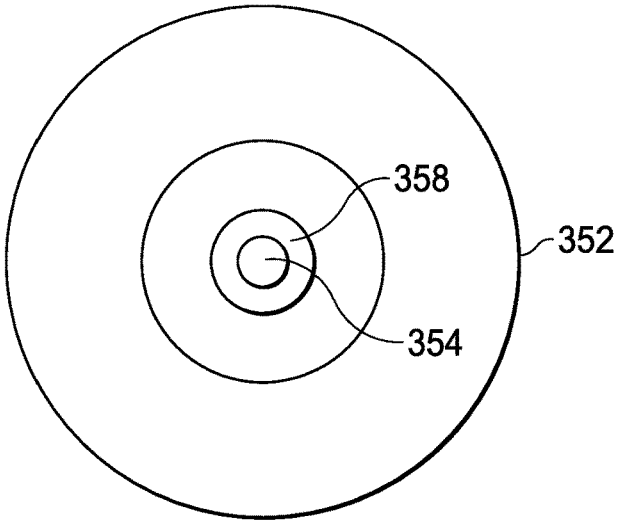
FIG. 3D is a side view of a roller and axle of a preferred embodiment.

Referring to FIG. 2, rotary shelf assembly 100 is mounted to blind corner cabinet 200. Blind corner cabinet 200 includes front panel 202 opposite rear panel 204. In a preferred embodiment, rear panel 204 is one to three inches wider than width 126. Front panel 202 is connected to rear panel 204 by side panels 206 and 208. Side panel 206 opposes side panel 208. Front panel 202, rear panel 204, and side panels 206 and 208 are all connected to floor panel 222. A counter top (not shown) is connected to front panel 202, rear panel 204, and side panels 206 and 208. Front panel 202 includes opening 210. Opening 210 is a gap between edges 212 and 214. Opening 210 provides access to interior 216 of blind corner cabinet 200 and can be concealed by cabinet door 218. Cabinet door 218 is pivotally connected to front panel 202 with a plurality of hinges at corner axis point 220 proximate edge 212. In a preferred embodiment, opening 210 is one to three inches wider than depth 128.

The universal frame brackets of rotary shelf assembly 100 are mounted to front panel 202 at edge 212. As shown, blind corner cabinet 200 is oriented in a right-hand configuration as opening 210 is to the right of the majority of front panel 202. Rotary shelf assembly 100 can easily accommodate a left-hand configuration as well which will be described further later.

Referring to FIGS. 3A-3D, universal frame bracket 108 is comprised of flange 302 extending from flange 304 at a generally right angle. Base 306 is connected to a horizontal edge of both flanges 302 and 304. In a preferred embodiment, the flanges are welded along seam 305. In other embodiments, the flanges can be rigidly attached with rivets or nuts and bolts. Flare 308 extends from a vertical edge of flange 302 at a generally right angle. Flare 310 extends from a vertical edge of flange 304 at a generally right angle. The plane of flange 304 is parallel to the plane of flange 308. The plane of flange 302 is parallel to the plane of flange 310. Flange 302 includes a set of mounting holes 312. Flange 304 includes a set of mounting holes 314. Flare 308 has a set of mounting holes 316 and flare 310 has a set of mounting holes 318. Base 306 is generally circular and defines hole 320. Hole 320 is centrally positioned on base 306 and sized to accept rod 120. Base 306 includes mounting holes 322. Base 306 further includes markings 324 and 326. In a right-hand configuration as shown, mounting hardware 330, such as wood screws, are sized to engage mounting holes 314 and attach universal frame bracket 108 to front panel 202. Mounting hardware 332 are sized to engage mounting holes 318 and attach universal frame bracket 108 to edge 212 of front panel 202. Alternatively, when blind corner cabinet 200 is oriented in a left-hand configuration and opening 210 is to the left of the majority of front panel 202, mounting hardware 330 and 332 would be used to secure universal frame bracket 108 to front panel 202 through mounting holes 312 and 316, respectively. Universal frame bracket 118 is identical to universal frame bracket 108 and will not be described further.

Rotary coupling 106 is generally circular having outer edge 338 extending between lower surface 340 and an upper surface 342. Rotary coupling 106 has a concentrically aligned inner stanchion 344 defining hole 346. Hole 346 is positioned to align with hole 320 and is sized to accept rod 120. A plurality of slats 348 radiate from inner stanchion 344 to outer edge 338. A plurality of vertically oriented stanchions 350 extend from lower surface 340, each defining a threaded hole. Rollers 352 and 353 are free to rotate about axles 354 and 355, respectively. In a preferred embodiment, the rollers are Teflon and are optionally supported by needle bearings 358, which ride on each of the axels. Rollers 352 and 353 extend above upper surface 342 and do not contact lower surface 340. Axles 354 and 355 each extend between inner stanchion 344 and outer edge 338. Horizontally oriented stanchion 356 interrupts outer edge 338 and extends to inner stanchion 344. Stanchion 356 defines a threaded hole which leads to hole 346. Set screw 360 is sized to engage the threaded hole of stanchion 356 and is used to removably secure rotary coupling 106 to rod 120. Mounting hardware 362, such as machine screws, are sized to pass through mounting holes 322 and threadably engage the threaded holes of stanchions 350 to secure rotary coupling 106 to universal frame bracket 108. Rotary coupling 116 is identical to rotary coupling 106 and attaches to universal frame bracket 118 in the same manner and will not be described further.

Figure 4A:
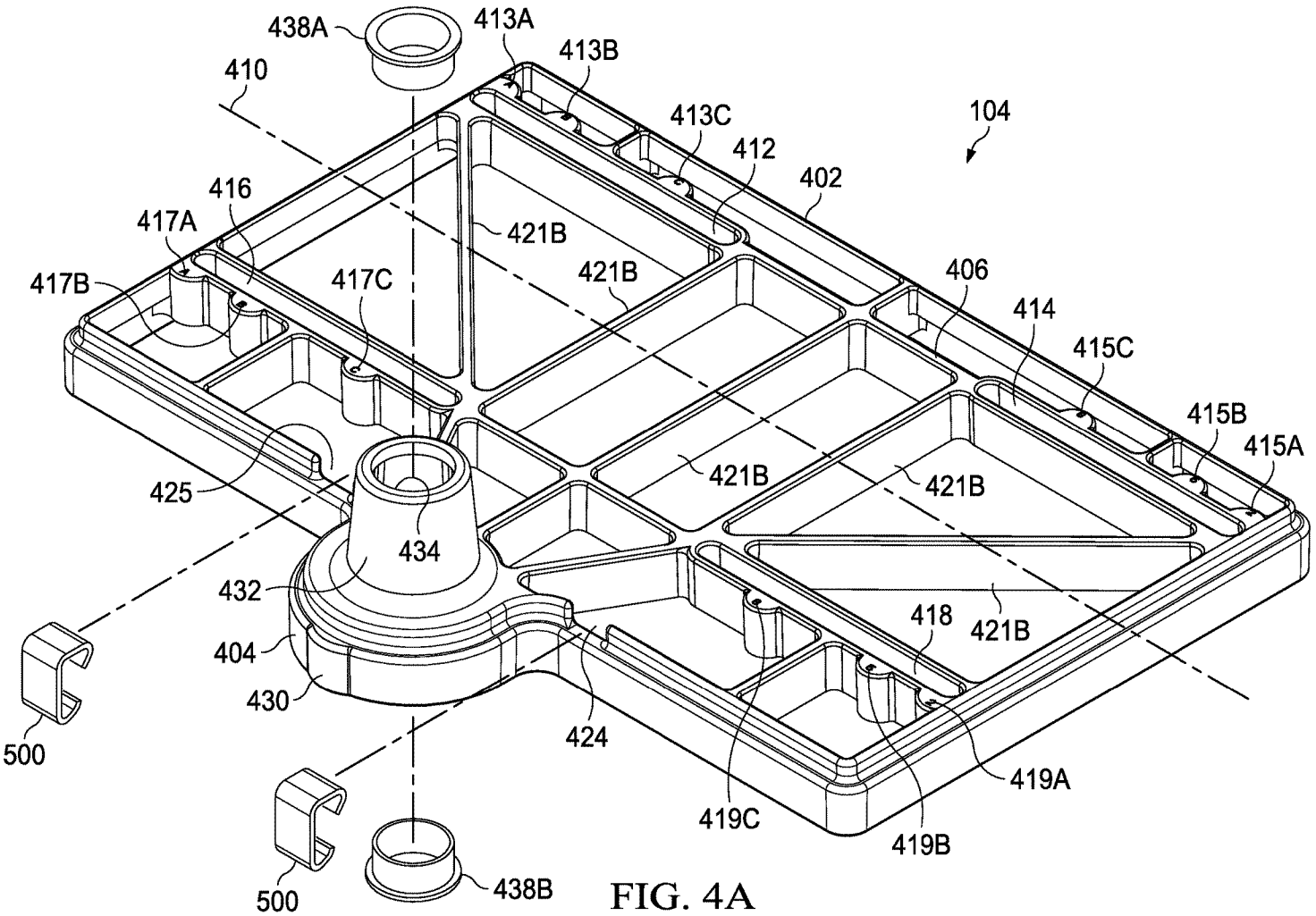
FIG. 4A is an exploded isometric view from the top of a rotary support of a preferred embodiment.
Figure 4B:
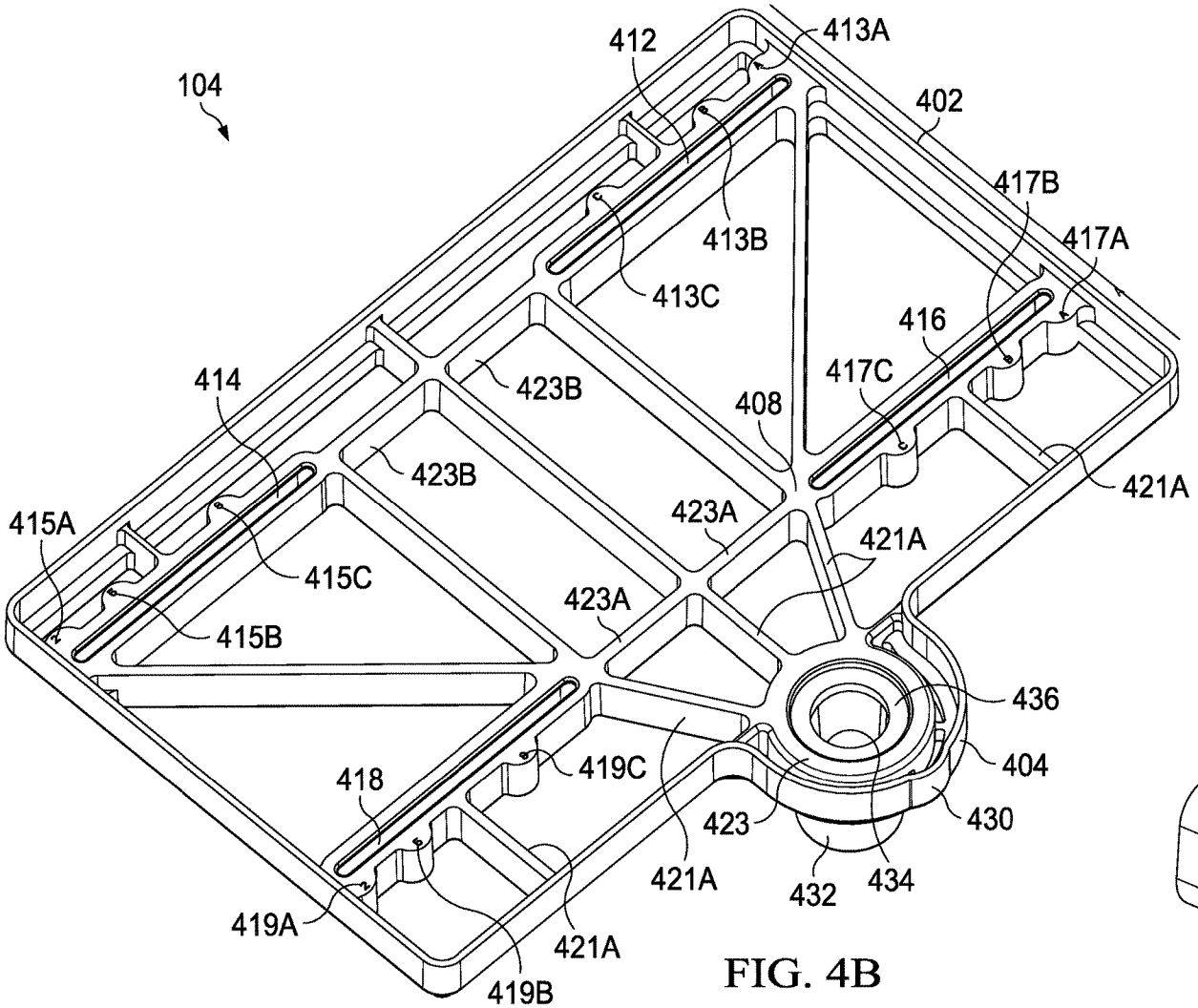
FIG. 4B is an isometric view from the bottom of a rotary support of a preferred embodiment.

Referring to FIGS. 4A and 4B, rotary support 104 includes platform 402 integrally formed with collar 404. Platform 402 is generally rectangular and has upper surface 406, lower surface 408, and longitudinal axis 410. Support ribs 421B are positioned between cross supports 423A and 423B. Support ribs 421A extend from circular support 423 to cross support 423A. In a preferred embodiment, the support ribs are integrally formed with the rotary support.

Slots 412, 414, 416, and 418 provide an oblong shaped opening from upper surface 406 through to lower surface 408. Slots 412, 414, 416, and 418 have longitudinal axes parallel with longitudinal axis 410. Adjacent slot 412 are markings 413A, 413B, and 413C. Adjacent slot 414 are markings 415A, 415B, and 415C. Adjacent slot 416 are markings 417A, 417B, and 417C. Adjacent slot 418 are markings 419A, 419B, and 419C. All markings are present on both upper surface 406 and lower surface 408. Upper surface 406 includes ridge 422 along its perimeter. Ridge 422 includes notches 424 and 425 proximate collar 404.

Collar 404 includes stop 430 and stanchion 432. In a preferred embodiment, stop 430 is integrally formed collar 404. In alternate embodiments, stop 430 may be an arc shaped extension attached to collar 404 manufactured of dense foam, rubber, or spring steel. Stop 430 is sized to frictionally engage flanges 302 and 304 during rotation of rotary support 104. Stanchion 432 defines hole 434. Hole 434 is cylindrical and sized to accept rod 120. Seated in hole 434 are bushings 438A and 438B. Bushings 438A and 438B provide a friction reducing barrier between collar 404 and rod 120. The bushings also provides a smoother feel to the rotary motion between the parts. The exterior of stanchion 432 is frustoconical. Roller surface 436 is at the base of stanchion 432 and surrounds hole 434. Rollers 352 and 353 engage roller surface 436. Rotary support 114 is identical to rotary support 104 and will not be described further.

Figure 5:
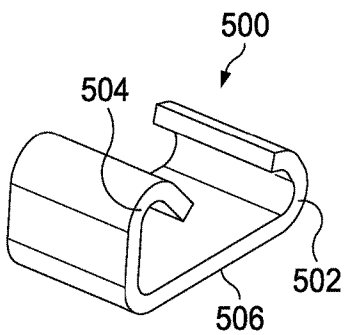
FIG. 5 is an isometric view of a bumper clip of a preferred embodiment.

Referring to FIG. 5, bumper clip 500 is shown. Bumper clip 500 comprises hook 502, hook 504, and surface 506. A first bumper clip 500 is removably attached to rotary support 104 at notch 424 and a second bumper clip 500 at notch 425. Each bumper clip 500 wraps around the exterior edge of platform 402 such that hook 502 engages upper surface 406, hook 504 engages lower surface 408, and surface 506 is exposed. In a preferred embodiment, bumper clip 500 is manufactured of injection molded plastic or polyvinyl chloride (PVC).

Figure 6A:
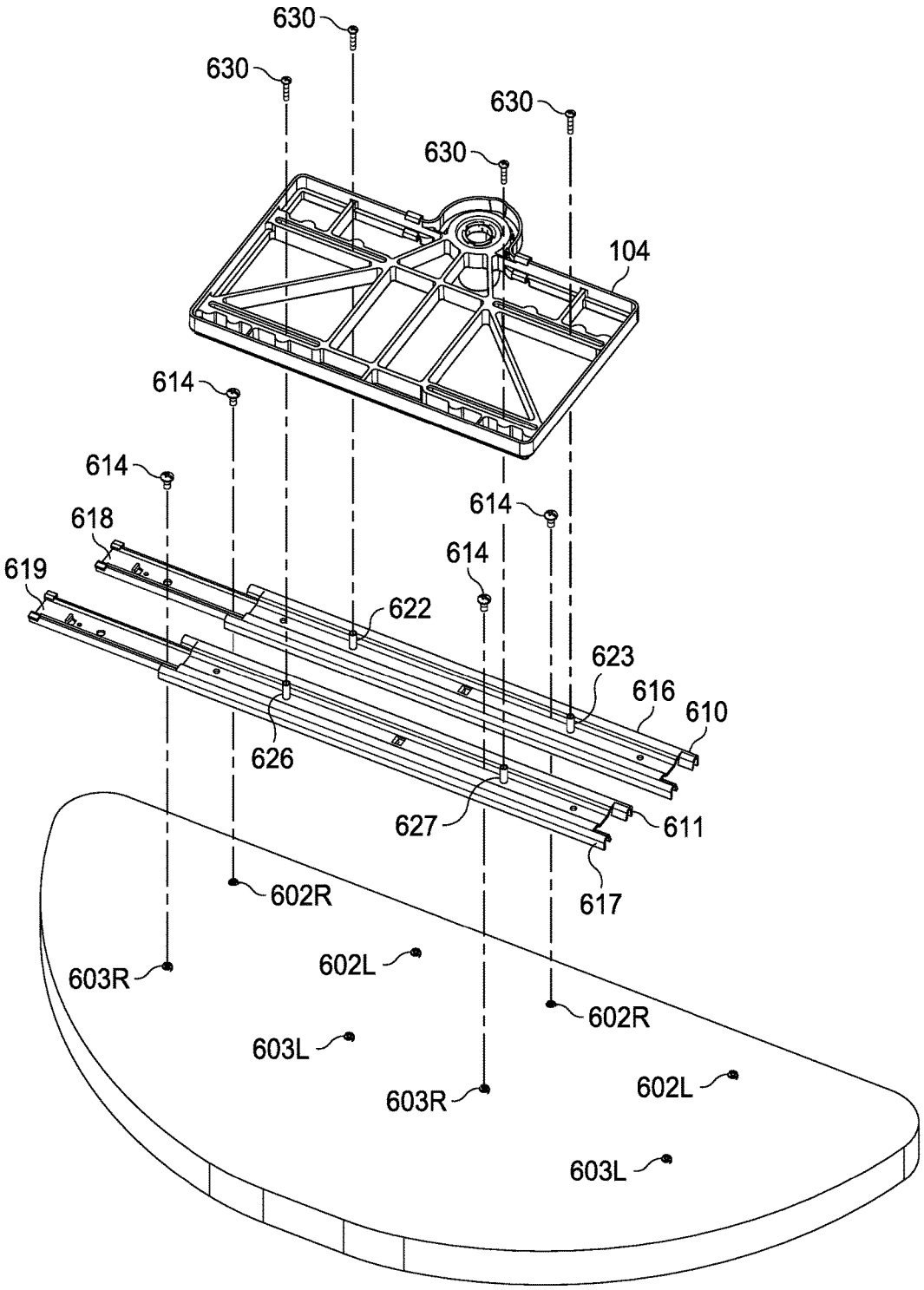
FIG. 6A is an exploded isometric view of a rotary support, a set of slide assemblies, and a shelf of a preferred embodiment.

Referring to FIG. 6A, the underside of each shelf has mounting holes 602R, 603R, 602L, and 603L. Mounting holes 602R are linearly aligned with mounting holes 602L. Mounting holes 603R are linearly aligned with mounting holes 603L. Drawer slide assemblies 610 and 611 each have two or more telescoping rails. In a preferred embodiment, drawer slide assembly 610 includes outer rail 616 telescopically engaged with inner rail 618 and drawer slide assembly 611 includes outer rail 617 telescopically engaged with inner rail 619. In alternate embodiments, additional telescoping rails are possible. For a right-hand blind corner cabinet configuration, inner rail 618 is mounted to the underside of the shelf with mounting hardware 614 through mounting holes 602R. Inner rail 619 is mounted to the underside of the shelf with mounting hardware 614 through mounting holes 603R. For a left-hand blind corner cabinet configuration, inner rail 619 is mounted to the underside of the shelf with mounting hardware 614 through mounting holes 602L and inner rail 619 is mounted to the underside of the shelf with mounting hardware 614 through mounting holes 603L.

Primary stanchion 622 and secondary stanchion 623 extend from outer rail 616. Primary stanchion 626 and secondary stanchion 627 extend from outer rail 617. Primary stanchions 622 and 626 and secondary stanchions 623 and 627 are sized to slidingly engage slots 412, 414, 416, and 418. Each stanchion includes a threaded hole sized to receive mounting hardware 630 to adjustably attach rotary support 104 to outer rails 616 and 617. The stanchions enter the slots from upper surface 406 but stop short of the plane of lower surface 408 such that mounting hardware 630 can be secured against lower surface 408. Which slot each stanchion engages and where along the slot each stanchion is positioned is determined by right and left-hand cabinet configuration and shelf size.

Figure 6B:
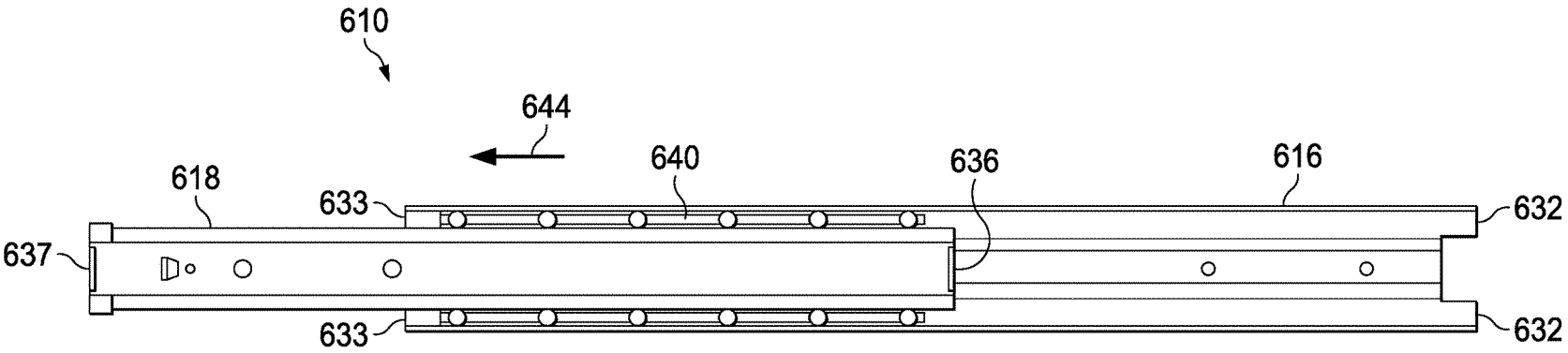
FIG. 6B is a plan view of a drawer slide assembly of a preferred embodiment.
Figure 6C:
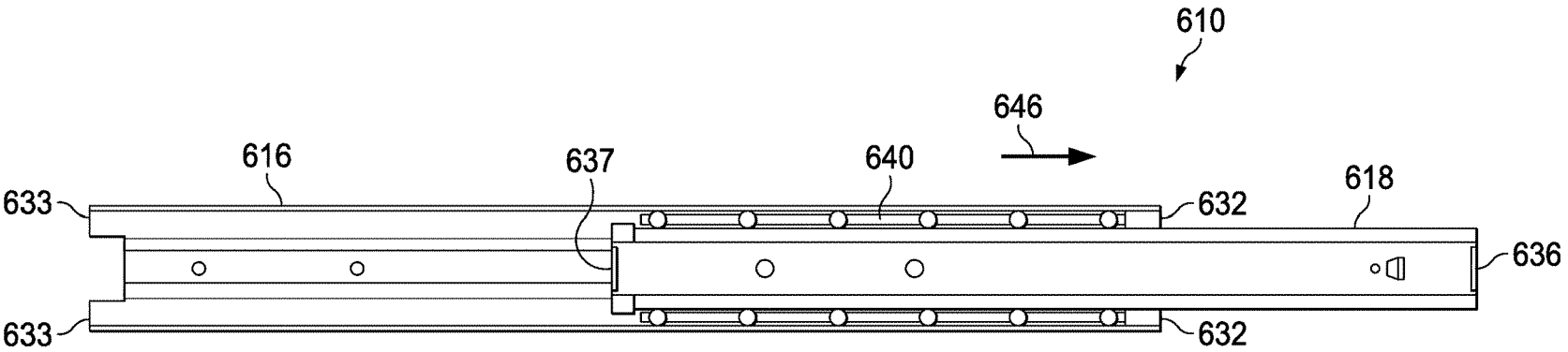
FIG. 6C is a plan view of a drawer slide assembly of a preferred embodiment.

Referring to FIGS. 6B and 6C, drawer slide assembly 610 is shown. Bearing cage 640 is slidingly disposed between outer rail 616 and inner rail 618. Outer rail 616 includes flanges 632 and 633 on opposite ends. Inner rail 618 includes flanges 636 and 637 on opposite ends. Flanges 632, 633, 636 and 637 and bearing cage 640 limit the sliding range of the inner rail relative to the outer rail and prevent disengagement. The linear travel of inner rail 616 relative to outer rail 618 in direction 644 is limited as bearing cage 640 abuts flange 633 and flange 636 abuts bearing cage 640. The linear travel of inner rail 616 relative to outer rail 618 in direction 646 is limited as bearing cage 640 abuts flange 632 and flange 637 abuts bearing cage 640.

Figure 6D:
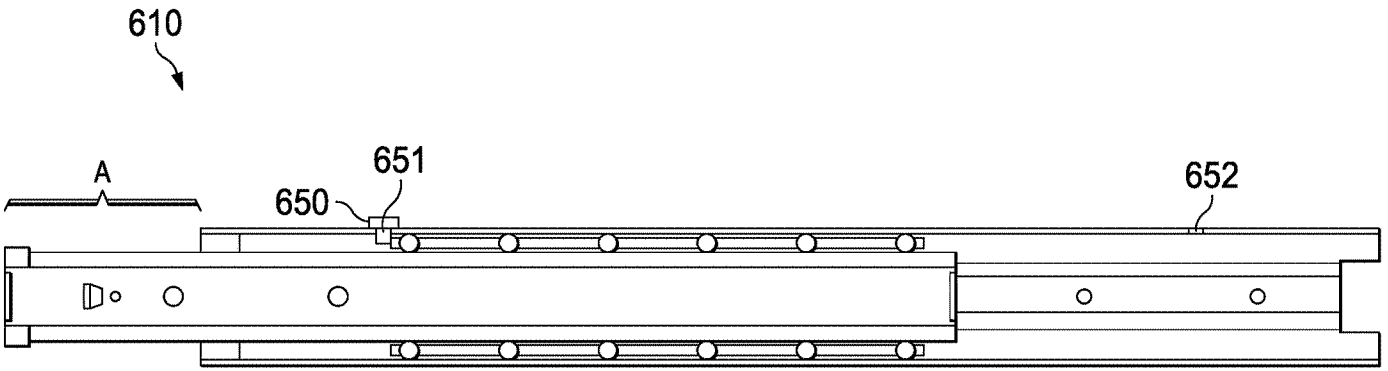
FIG. 6D is a plan view of an alternate embodiment of a drawer side assembly.
Figure 6E:
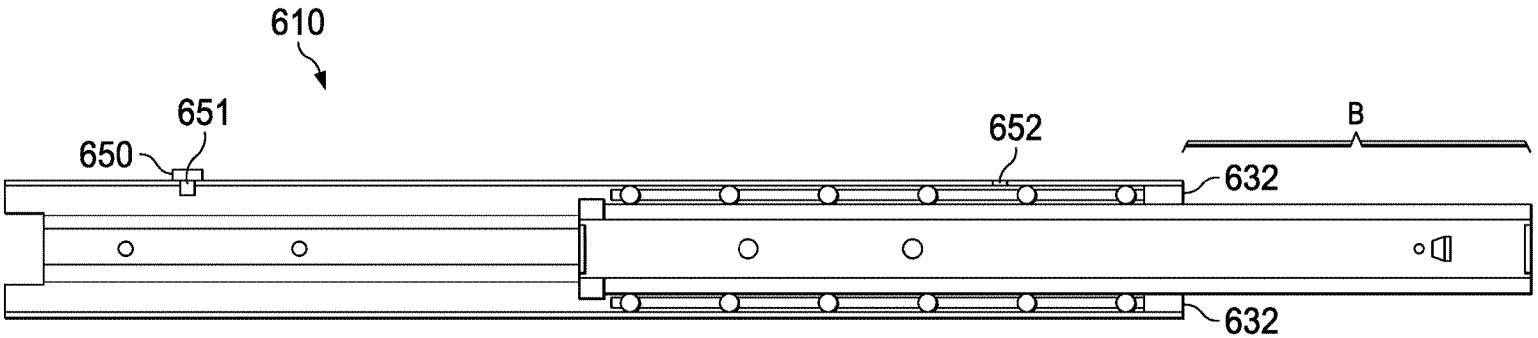
FIG. 6E is a plan view of an alternate embodiment of a drawer side assembly.

Referring to FIGS. 6D and 6E, an alternate embodiment is described. Set screw 650 is provided in threaded hole 651. The set screw limits the travel of the bearing cage in the left hand direction. The bearing cage in turn limits the travel of inner rail 616 to the distance "A". The travel of the inner slide is limited only by flange 632 in the right hand direction, and so extends to distance "B". As a result, the placement of the set screw allows a slide travel greater in the right hand direction than in the left hand direction. This functionality is useful because it prevents the shelf from impacting the interior wall of the cabinet where in the stowed position.

If a shorter travel is desired in the right hand direction than the left hand direction, then the set screw can be moved to hole 652 to limit the travel of the bearing cage and the slide in the left hand direction.

Figure 7:
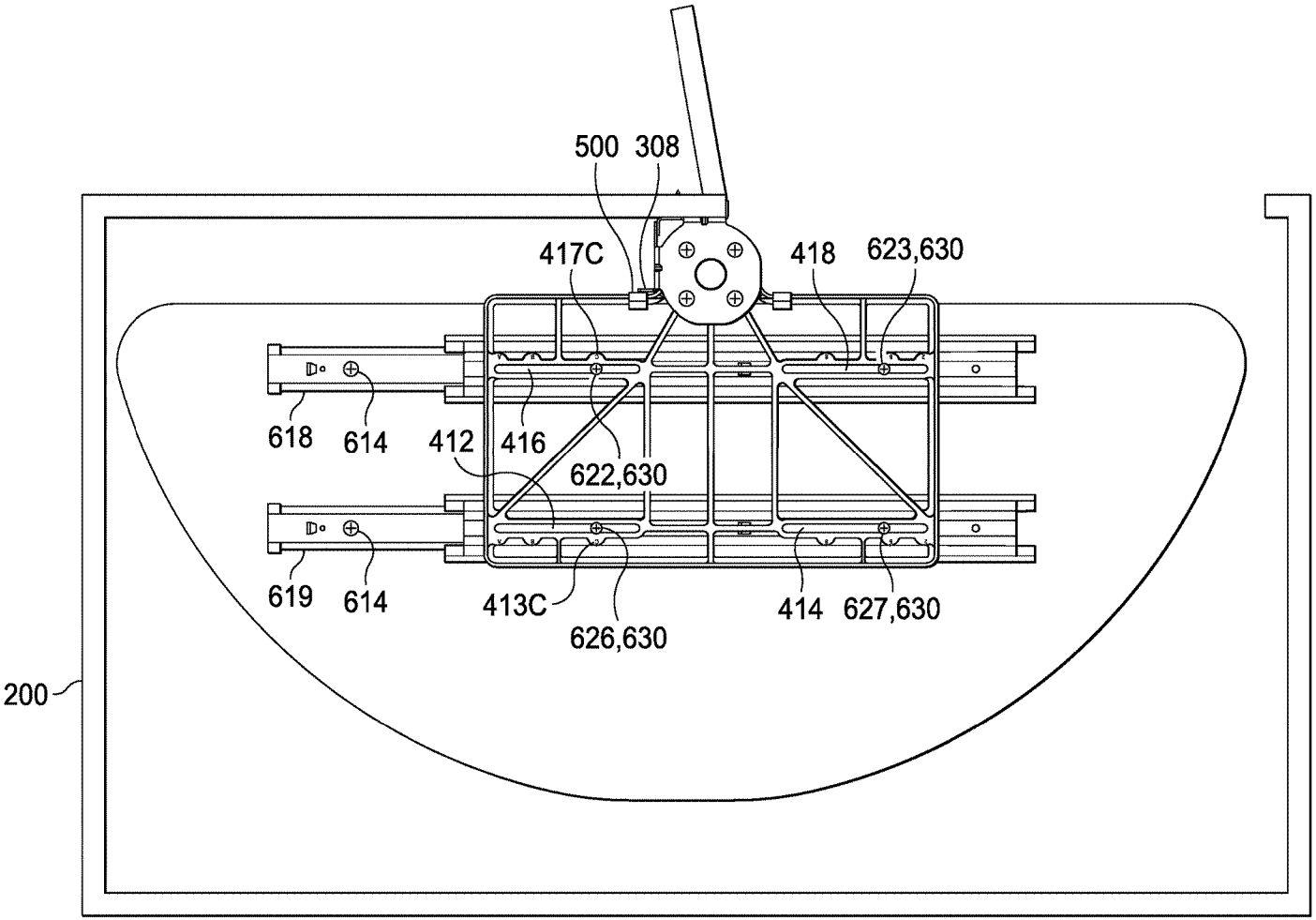
FIG. 7 is a bottom plan view of a rotary shelf assembly of a preferred embodiment mounted to a blind corner cabinet.

Referring to FIG. 7, the underside of a shelf attached to a rotary support is described. The shelf is attached to rotary support 104 commensurate with a right-hand blind corner cabinet configuration where width 126 of the shelf is 38 inches. Inner rail 618 is mounted to the underside of the shelf with mounting hardware 614 in mounting holes 602R. Inner rail 619 is mounted to the underside of the shelf with mounting hardware 614 in mounting holes 603R. Primary stanchion 622 extends from outer rail 616 through slot 416 and is positioned next to marking 417C. Secondary stanchion 623 extends from outer rail 616 through slot 418. Primary stanchion 626 extends from outer rail 616 through slot 412 and is positioned next to marking 413C. Secondary stanchion 627 extends from outer rail 616 through slot 414. Secondary stanchions are not required to be positioned near any markings. Mounting hardware 630 engaged with primary and secondary stanchions and the rotary support secures the rotary support to the drawer slide assembly and thus the shelf.

In one preferred embodiment, the mounting point of the primary stanchion to the rotary support is dictated by the size of the shelf and whether the blind corner cabinet is a right or left-hand configuration. Markings 413A, 413B, and 413C; 415A, 415B, and 425C; 417A, 417B, and 417C; and 419A, 419B, and 419C are pre-determined mounting points that correspond to shelf widths of 32 inches, 35 inches, and 38 inches, respectively. Table 1 indicates which pre-determined mounting point should be used for the primary stanchions in each scenario.

TABLE 1

| | | 32 Inch Shelf | 35 Inch Shelf | 38 Inch Shelf |
|---|---|---|---|---|
| Right-Hand Configuration | Primary Stanchion 622 | 417A | 417B | 417C |
| | Primary Stanchion 626 | 413A | 413B | 413C |
| Left-Hand Configuration | Primary Stanchion 622 | 415A | 415B | 415C |
| | Primary Stanchion 626 | 419A | 419B | 419C |

In other embodiments, different sized shelves may be accommodated by scaling the distance between mounting points or by providing a greater or lesser number of mounting points.

The attachment of the shelf to a rotary support can be converted to a left-hand blind corner cabinet configuration. Drawer slide assemblies 610 and 611 are rotated 180° such that inner rail 618 is attached to the underside of the shelf using mounting hardware 614 in mounting holes 603L and inner rail 619 is attached to the shelf in mounting holes 602L. Primary stanchion 622 extends through slot 414 next to the appropriate marking according to the above Table 1. Secondary stanchion 623 extends through slot 412. Primary stanchion 626 extends through slot 418 next to the appropriate marking according to the above table. Secondary stanchion 627 extends through slot 416.

Figure 8A:
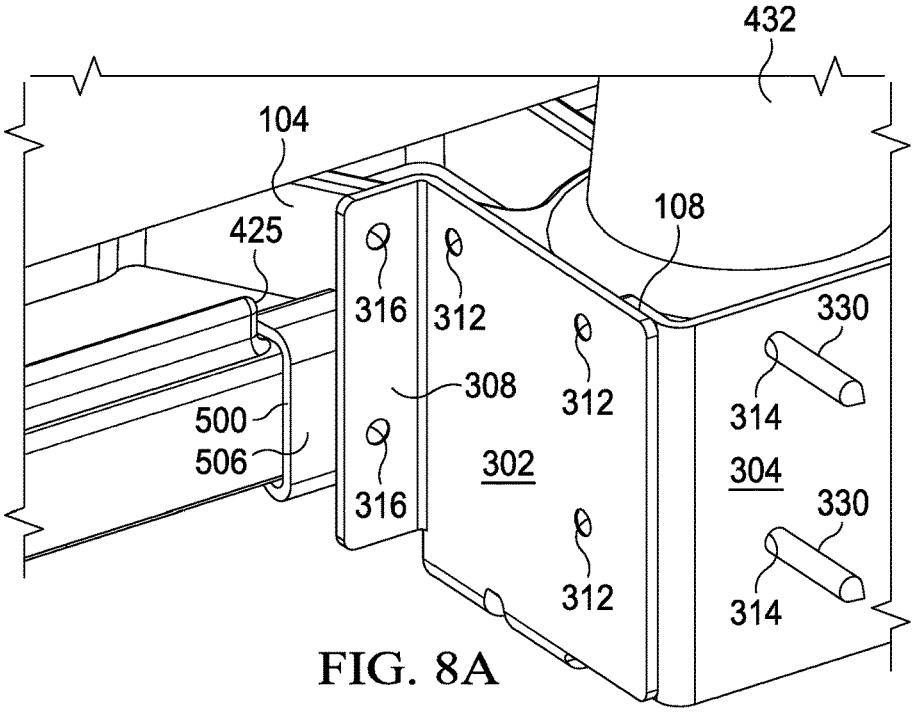
FIG. 8A is a partial isometric view of a shelf in a stowed position abutting a universal frame bracket of a preferred embodiment.
Figure 8B:
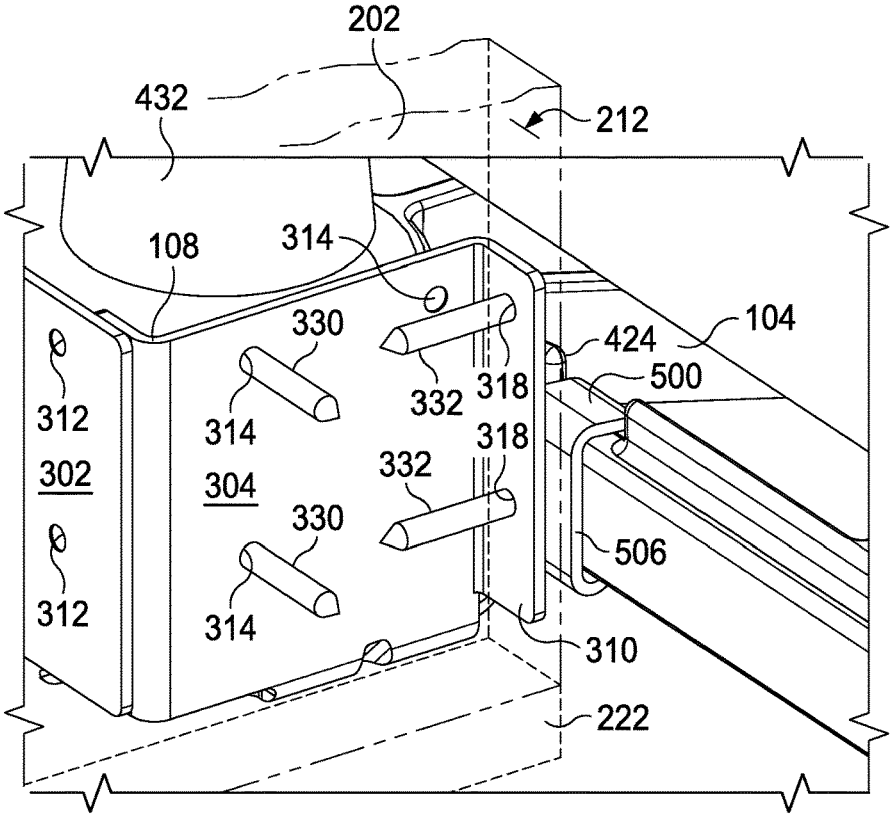
FIG. 8B is a partial isometric view of a shelf in a rotated position abutting a universal frame bracket of a preferred embodiment

Referring to FIGS. 8A and 8B, universal frame bracket 108 is attached to front panel 202 commensurate with a right-hand blind corner cabinet configuration. Flange 304 abuts front panel 202 and is secured to front panel 202 with mounting hardware 330 through mounting holes 314. Flange 310 abuts edge 212 of front panel 202 and is secured to edge 212 with mounting hardware 332 through mounting holes 318. Base 306 of universal frame bracket 108 abuts floor panel 222. In the event additional shelves are desired, universal frame bracket 118 is mounted to front panel 202 and edge 212 in the same manner at a desired distance above floor panel 222.

As shown in FIGS. 7 and 8A, a shelf of rotary shelf assembly 100 is depicted in a stowed position. Bumper clip 500 is attached to rotary support 104 at notch 425. Surface 506 abuts flange 308 to cushion and eliminate any noise from the impact of rotary support 104 with universal frame 108. As shown in FIG. 8B, a shelf of rotary shelf assembly 100 is rotated 90° from the stowed position to a rotated position. Bumper clip 500 is attached to rotary support 104 at notch 424. Surface 506 abuts flange 310 to cushion and eliminate impact noise between rotary support 104 and universal frame 108.

The attachment of universal frame bracket 108 to front panel 202 can be easily converted to a left-hand blind corner cabinet configuration. In a left-hand blind corner cabinet configuration, opening 210 is to the left of front panel 202. Universal frame bracket 108 is rotated 90° such that flange 302 abuts front panel 202 and is secured to front panel 202 with mounting hardware 330 through mounting holes 312. Flange 308 abuts edge 212 of front panel 202 and is secured to edge 212 with mounting hardware 332 through mounting holes 316.

In use, rotary shelf assembly 100 is assembled by securing rotary coupling 106 to universal frame bracket 108 ensuring stanchion 356 is accessible. Universal frame bracket 108 is mounted to front panel 202 and edge 212 in a manner that corresponds to a right or left-hand blind corner cabinet configuration. Universal frame bracket 108 may or may not abut floor panel 222. Universal frame bracket 108 is not attached to floor panel 222. Drawer slide assemblies 610 and 611 are mounted to the underside of shelf 102 in the appropriate mounting holes for the chosen right or left-hand blind corner cabinet configuration. Rotary support 104 is mounted to drawer slide assemblies 610 and 611 in a manner that corresponds to size of shelf 102. Rod 120 is inserted through hole 346 in rotary coupling 106 and hole 320 in universal frame bracket 108 until rod 120 abuts floor panel 222. Rod 120 is not attached to floor panel 222. Set screw 360 is tightened within stanchion 356 until it abuts rod 120. Set screw 360 prevent rotation of rod 120 relative to universal frame bracket 108 and rotary coupling 106. Lastly, rotary support 104 is mounted onto rod 120 such that rod 120 enters hole 434 and roller surface 436 rests on rollers 352 and 353. Rotary support 104 and the attached shelf is free to rotate about longitudinal axis 122 of rod 120. Rotary shelf support 104 and the attached shelf slide parallel to longitudinal axis 410 via drawer slide assemblies 610 and 611. If additional shelves are desired the process is repeated such that the second universal frame bracket is mounted to front panel 202 and edge 212 at a desired spaced vertical distance from the already installed universal frame bracket.

Figure 9A:
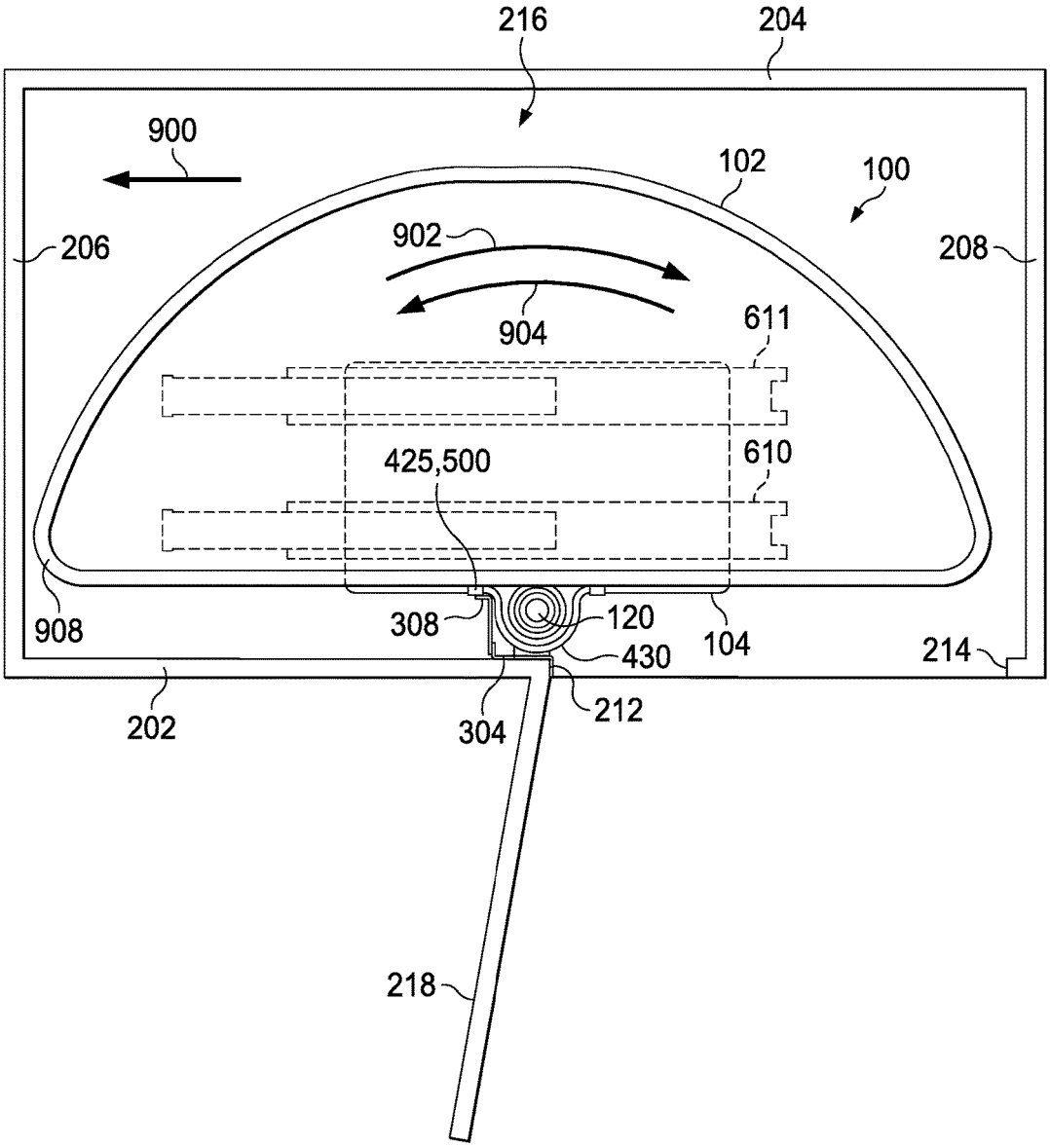
FIG. 9A is a plan view of a rotary shelf assembly of a preferred embodiment mounted to a blind corner cabinet in a stowed position.

Referring to FIG. 9A, rotary shelf assembly 100 with shelf 102 is shown in a stowed position within interior 216. Flange 304 abuts and is secured to front panel 202. Flange 310 abuts and is secured to edge 212. Stop 430 abuts flange 304. The frictional engagement of stop 430 with flange 304 retards rotational movement of rotary support 104 and attached shelf 102 about rod 120 in direction 902 and tends to retain the shelf in the stowed position. Surface 506 of bumper clip 500 attached to rotary support 104 in notch 425 abuts flange 308. The engagement of flange 308 with bumper clip 500 prevents rotation of the rotary support and shelf in direction 904. The abutment of the flanges of the inner and outer rails with the bearing cages in drawer slide assemblies 610 and 611 prevent shelf 102 from further linear movement in direction 900. As a result, end 908 of shelf 102 cannot contact side panel 206 when in the stowed position.

Figure 9B:
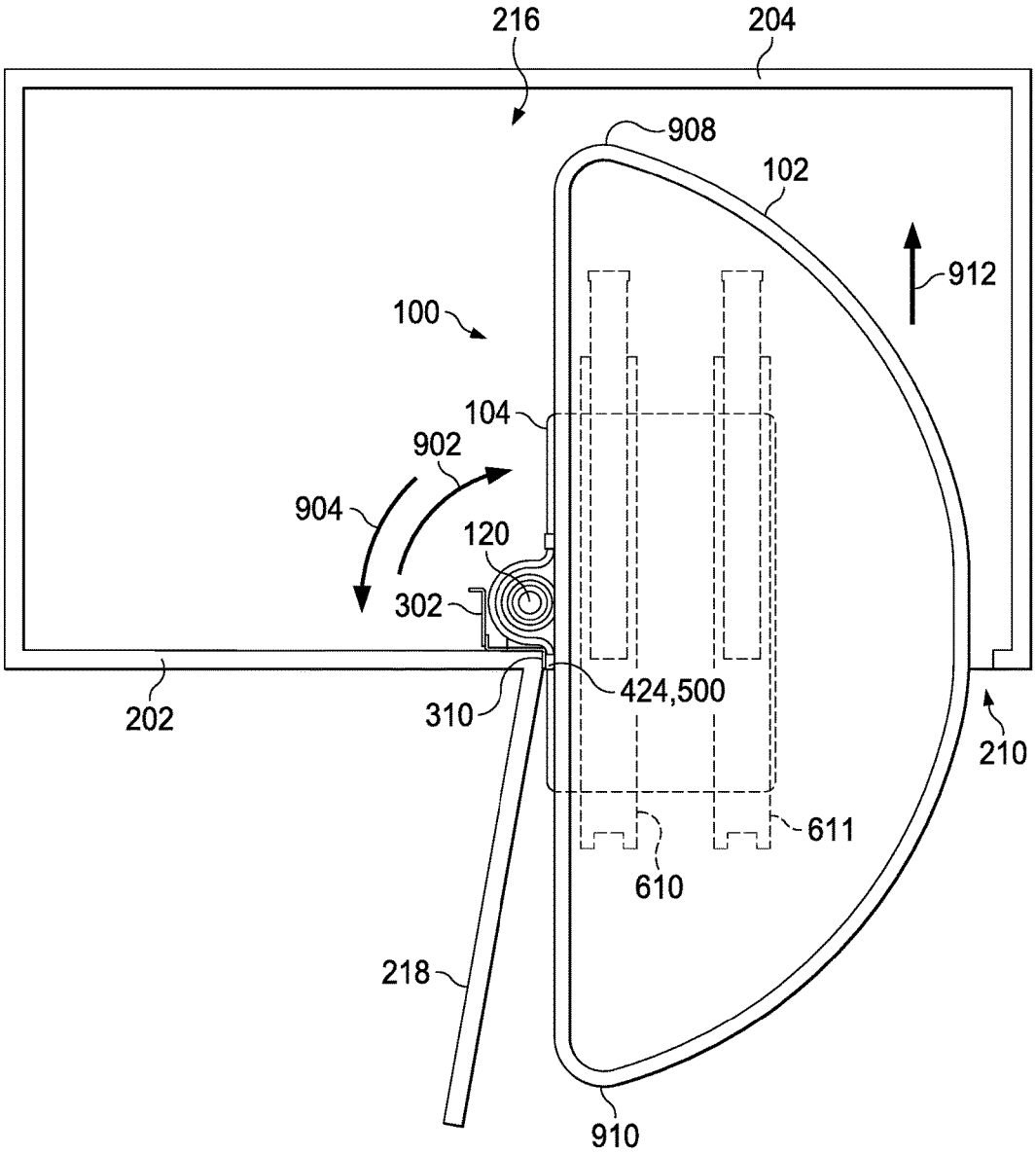
FIG. 9B is a plan view of a rotary shelf assembly of a preferred embodiment mounted to a blind corner cabinet in a rotated position.

Referring to FIG. 9B, rotary shelf assembly 100 with shelf 102 is shown in a position rotated 90° to the right. Rotary support 104 is rotated about the central axis of rod 120 in direction 902 from the stowed position. End 910 of shelf 102 protrudes from interior 216 through opening 210. Stop 430 moves from engagement with flange 304 to abut flange 302. The frictional engagement of stop 430 with flange 302 retards rotational movement of rotary support 104 and attached shelf 102 about rod 120 in direction 904 and biases the shelf in the rotated position. Surface 506 of bumper clip 500 attached to rotary support 104 in notch 424 abuts flange 310. The engagement of flange 310 with bumper clip 500 prevents further rotation of the rotary support and shelf in direction 902. The abutment of the flanges of the inner and outer rails with the bearing cages in drawer slide assemblies 610 and 611 prevents shelf 102 from linear movement in direction 912. As a result, end 908 of shelf 102 cannot contact rear panel 204 when in the rotated position. Shelf 102 has not moved linearly along drawer slides 610 and 611 from the stowed position shown in FIG. 9A.

Figure 9C:
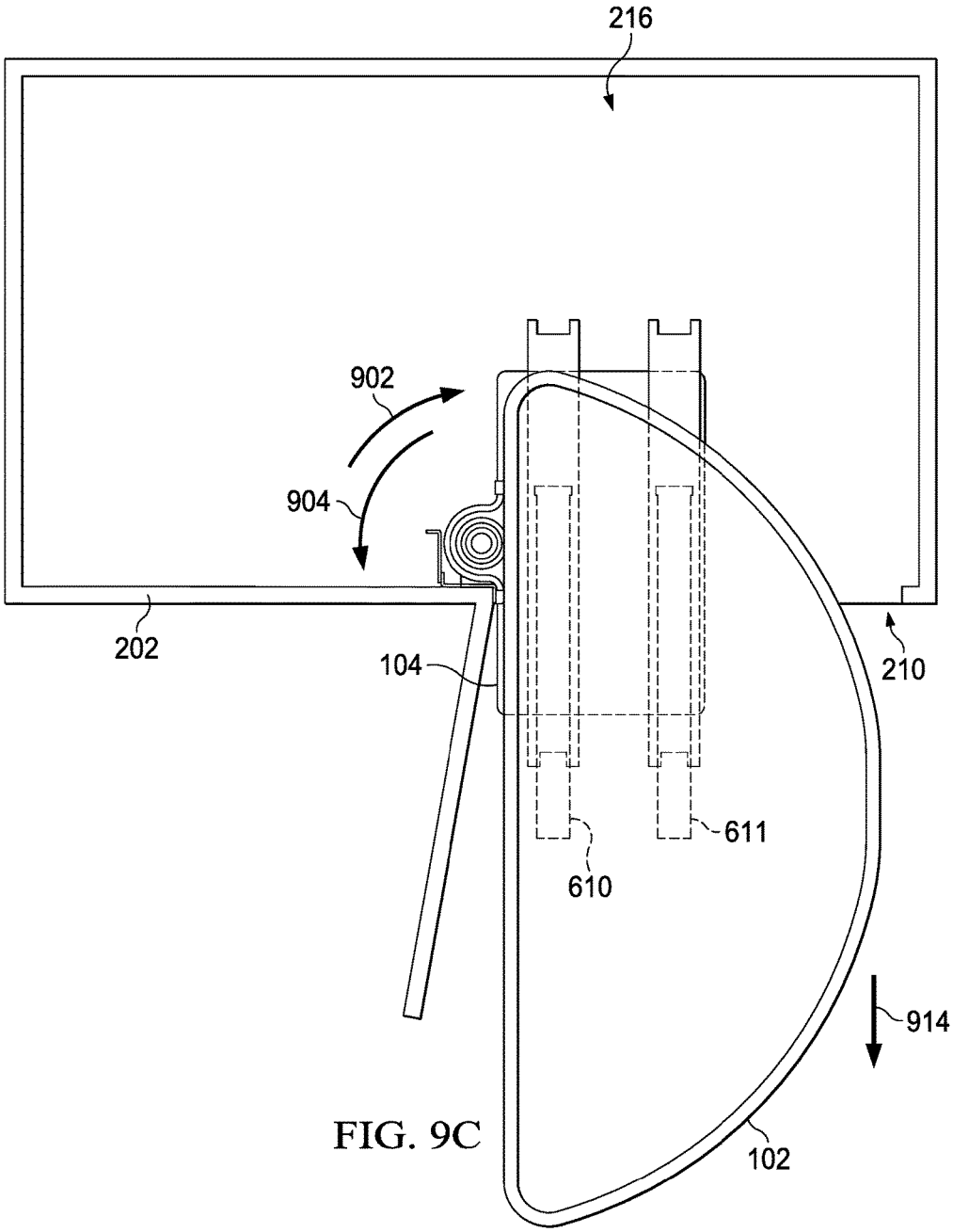
FIG. 9C is a plan view of a rotary shelf assembly of a preferred embodiment mounted to a blind corner cabinet in a deployed position.

Referring to FIG. 9C, rotary shelf assembly 100 with shelf 102 is shown in a deployed position extending from interior 216. Shelf 102 moves linearly in direction 914 through opening 210 until the drawer slide assemblies 610 and 611 reach the end of linear travel. Stop 430 abuts flange 302. The frictional engagement of stop 430 with flange 302 retards rotational movement of rotary support 104 and attached shelf 102 about rod 120 in direction 904. Bumper clip 500 attached to rotary support 104 in notch 424 abuts flange 310.

The engagement of flange 310 with bumper clip 500 prevents rotation of the rotary support and shelf in direction 902.

In order to store a shelf of rotary shelf assembly 100 from the deployed position to the stowed position, the movements are performed in reverse. The limited travel of the drawer slide assemblies and the bumper clips engaging the universal frame brackets prevent the shelf from contacting the rear and side panels of the blind corner cabinet during deployment and stowage movements.

If additional shelves are desired, it is unnecessary to dismantle rotary shelf assembly 100. A second universal frame bracket can receive rod 120 and be mounted to front panel 202 and edge 212 while the first universal frame bracket remains in place. Mounting holes 312 and 314 are accessible while rod 120 is positioned within holes 320 and 346. A second rotary support with an attached shelf is then mounted onto rod 120.

To adjust the height of either shelf, the rotary support and shelf are first disengaged from rod 120. Set screw 360 is loosened to disengage the rotary coupling from the rod. The mounting hardware securing the universal frame bracket to the front panel and the edge is removed. The universal frame bracket and rotary coupling are moved along rod 120 to the desired position. The universal frame bracket and the rotary coupling are remounted to the front panel and edge. The rotary coupling is secured to the rod with set screw 360. The universal frame bracket and rotary coupling is then positioned to receive the rotary support and attached shelf at the desired height. Mounting holes 312 and 314 are accessible while rod 120 is positioned within holes 320 and 346. In this way, the height of the shelves may be adjusted without dismantling the entire rotary shelf assembly.

It will be appreciated by those skilled in the art that changes could be made to the embodiments described above without departing from the broad inventive concept. It is understood, therefore, that this disclosure is not limited to the particular embodiments herein, but it is intended to cover modifications within the spirit and scope of the present disclosure as defined by the appended claims.

The invention claimed is:

1. A rotary shelf assembly for a blind corner cabinet having a front panel with an edge adjacent an opening, the assembly comprising:

a first frame bracket, having one or more flanges, configured to be mounted to the front panel;

a first rotary coupling connected to the first frame bracket;

a rod engaged with the first frame bracket and the first rotary coupling;

a first rotary support, moveably positioned about the rod, and rotatably engaged with the first rotary coupling;

a first set of slide assemblies adjustably attached to a first set of mounting points in the first rotary support;

a first shelf connected to the first set of slide assemblies; and, wherein the first shelf is capable of rotating about the rod from a stowed position within the blind corner cabinet and extending along the first set of slide assemblies to a deployed position through the opening.

2. The rotary shelf assembly of claim 1 further comprising:

a second frame bracket configured to be mounted to the front panel;

a second rotary coupling connected to the second frame bracket;

the rod engaged with the second frame bracket and the second rotary coupling;

a second rotary support, moveably positioned about with the rod, and rotatably engaged with the second rotary coupling;

a second set of slide assemblies adjustably attached to a second set of mounting points in the second rotary support;

a second shelf connected to the second set of slide assemblies; and, wherein the second shelf is independently capable of rotating about the rod from the stowed position within the blind corner cabinet and extending along the second set of slide assemblies to the deployed position through the opening.

3. A rotary shelf assembly for a blind corner cabinet having a front panel with a first edge adjacent an opening, the assembly comprising:

a first frame bracket, having a first flange, a second flange, and a base flange, configured to be mounted to the front panel;

wherein the first flange is configured to be mounted to the blind corner cabinet;

the first flange connected at a generally right angle to the second flange;

the base flange connected to the first flange and the second flange;

a first rotary coupling connected to the first frame bracket;

wherein the first rotary coupling is connected to the base flange;

a rod engaged with the first frame bracket and the first rotary coupling;

a first rotary support, moveably positioned about the rod, and rotatably engaged with the first rotary coupling;

a first set of slide assemblies adjustably attached to a first set of mounting points in the first rotary support;

a first shelf connected to the first set of slide assemblies; and, wherein the first shelf is capable of rotating about the rod from a stowed position within the blind corner cabinet and extending along the first set of slide assemblies to a deployed position through the opening.

4. The rotary shelf assembly of claim 3 wherein the first frame bracket further comprises:

a third flange extending from the first flange and parallel with the second flange; and, a fourth flange extending from the second flange and parallel with the first flange.

5. The rotary shelf assembly of claim 3 wherein the first frame bracket further comprises:

a third flange extending from the first flange and parallel with the second flange;

a fourth flange extending from the second flange and parallel with the first flange; and, wherein, for a right-hand blind corner cabinet configuration, the second flange is configured to be mounted to the front panel and the fourth flange is configured to be mounted to the first edge; and, wherein, for a left-hand blind corner cabinet configuration, the first flange is configured to be mounted to the front panel and the third flange is configured to be mounted to a second edge.

6. The rotary shelf assembly of claim 3 wherein the base flange has a hole and is engaged with the rod.

7. The rotary shelf assembly of claim 1 wherein the first rotary coupling further comprises:

a set of rollers engaged with the first rotary support.

8. The rotary shelf assembly of claim 1 wherein the first rotary coupling further comprises:

a stanchion defining a hole and, wherein the rod is inserted through the hole.

9. The rotary shelf assembly of claim 1 wherein the first rotary coupling further comprises:

a vertically oriented stanchion defining a hole, where the rod is inserted through the hole;

a horizontally oriented stanchion defining a threaded hole leading to the hole; and, a set screw engaged with threads of the threaded hole and abutting the rod.

10. The rotary shelf assembly of claim 1 wherein the first rotary support further comprises:

a set of markings adjacent the first set of mounting points; and, wherein the set of markings indicates one or more mounting positions of the first rotary support to the first set of slide assemblies.

11. The rotary shelf assembly of claim 1 wherein the first rotary support further comprises:

a first marking adjacent the first set of mounting points indicating a first mounting position of the first rotary support to the first set of slide assemblies corresponding to a first shelf size;

a second marking adjacent the first set of mounting points indicating a second mounting position of the first rotary support to the first set of slide assemblies corresponding to a second shelf size; and, a third marking adjacent the first set of mounting points indicating a third mounting position of the first rotary support to the first set of slide assemblies corresponding to a third shelf size.

12. A rotary shelf assembly for a blind corner cabinet having a front panel with an edge adjacent an opening, the assembly comprising:

a frame bracket configured to be mounted to the front panel;

a rotary coupling connected to the frame bracket;

a rod engaged with the frame bracket and the rotary coupling;

a rotary support, moveably positioned about the rod, and rotatably engaged with the rotary coupling;

a first bumper clip attached to the rotary support and abutting a first flange of the frame bracket when the assembly is in the stowed position;

a second bumper clip attached to the rotary support and abutting a second flange of the frame bracket when the assembly is in the deployed position;

a set of slide assemblies adjustably attached to a set of mounting points in the rotary support;

a shelf connected to the set of slide assemblies; and, wherein the shelf is capable of rotating about the rod from a stowed position within the blind corner cabinet and extending along the set of slide assemblies to a deployed position through the opening.

13. The rotary shelf assembly of claim 12 wherein the rotary support further comprises:

a platform, including the set of mounting points, connected to the set of slide assemblies;

a collar integrally formed with the platform and engaged with the rod; and a stop, extending from the collar, frictionally engaged with the first flange of the frame bracket when the assembly is in the stowed position and frictionally engaged with the second flange of the frame bracket when the assembly is in the deployed position.

14. The rotary shelf assembly of claim 1 wherein the first shelf is semi-circular shaped.

15. The rotary shelf assembly of claim 1 wherein the first shelf further comprises:

a smooth upper surface;

a lower surface having a first set of mounting holes for connecting the first set of slide assemblies to the first shelf in a right-hand blind corner configuration and a second set of mounting holes for connecting the first set of slide assemblies to the first shelf in a left-hand blind corner configuration.

16. A method of moving a rotary shelf assembly from a stowed position within a dead space of a blind corner cabinet to a deployed position through an opening in a front panel of the blind corner cabinet, comprising:

providing a frame bracket, having a first flange extending into the dead space and a second flange adjacent the opening, attached to the front panel;

providing a rod secured in the frame bracket;

providing a rotary support moveably positioned about the rod and rotatably engaged with the frame bracket;

providing a shelf slidingly engaged with the rotary support with a set of slide assemblies;

abutting the first flange with the rotary support when in the stowed position and preventing contact between the shelf and the front panel;

rotating the rotary support generally 90° about the rod to a rotated position such that the shelf protrudes through the opening;

abutting the second flange with the rotary support when in the rotated position; and, extending the shelf along the set of slide assemblies further through the opening to the deployed position.

17. The method of claim 16 further comprising:

adjusting a height of the rotary shelf assembly, including:

detaching the frame bracket from the front panel;

disengaging the frame bracket from the rod;

repositioning the frame bracket along the rod;

securing again the frame bracket to the rod; and, reattaching the frame bracket to the front panel.

18. A rotary shelf assembly for a blind corner cabinet comprising:

a universal frame bracket, having a first flange, configured to be mounted to the blind corner cabinet, having a second flange extending at a generally right angle from the first flange, and having a base flange engaged with a rod;

a rotary support moveably positioned about the rod and rotatably engaged with a coupling mounted on the base flange;

a set of slide assemblies adjustably mounted to a set of mounting points in the rotary support; and, a semi-circular shaped shelf, having a smooth upper surface, and having a lower surface mounted to the set of slide assemblies.

19. The rotary shelf assembly of claim 18 wherein the semi-circular shaped shelf is capable of moving from a stowed position within the blind corner cabinet;

wherein the rotary support abuts the second flange in the stowed position;

wherein the rotary support is moved to a rotated position from the stowed position;

wherein the shelf is pivoted generally 90° about a longitudinal axis of the rod from the stowed position to the rotated position; and, wherein the rotary support abuts the first flange in the rotated position.

20. The rotary shelf assembly of claim 19 wherein the semi-circular shaped shelf is capable of moving from the rotated position to a deployed position; and, wherein the semi-circular shaped shelf slides linearly along the set of slide assemblies away from the blind corner cabinet from the rotated position to the deployed position.

21. The rotary shelf assembly of claim 18 wherein at least one slide assembly of the set of slide assemblies further comprises a set screw located in a bearing guide track of the at least one slide assembly that limits sliding of the at least one slide assembly in a first direction greater than a second direction.

* * * * *